US009988769B2

(12) United States Patent
Roell

(10) Patent No.: US 9,988,769 B2
(45) Date of Patent: Jun. 5, 2018

(54) METHOD FOR FORMING A SURFACE AROUND AN EMBEDDED CONDUIT

(71) Applicant: Argonics, Inc., Gwinn, MI (US)

(72) Inventor: Joseph Roell, Gwinn, MI (US)

(73) Assignee: Argonics, Inc., Gwinn, MI (US)

( * ) Notice: Subject to any disclaimer, the term of this patent is extended or adjusted under 35 U.S.C. 154(b) by 0 days. days.

(21) Appl. No.: 15/167,133

(22) Filed: May 27, 2016

(65) Prior Publication Data

US 2016/0348323 A1 Dec. 1, 2016

Related U.S. Application Data

(60) Provisional application No. 62/167,117, filed on May 27, 2015.

(51) Int. Cl.

| | |
|---|---|
| ***E01C 11/00*** | (2006.01) |
| ***E01C 3/00*** | (2006.01) |
| ***E02D 29/14*** | (2006.01) |
| ***E01C 23/06*** | (2006.01) |

(52) U.S. Cl.

CPC ..... *E01C 11/005* (2013.01); *E01C 3/00* (2013.01); *E01C 23/06* (2013.01); *E02D 29/14* (2013.01); *E02D 29/1409* (2013.01)

(58) Field of Classification Search

CPC ..... E02D 29/14; E02D 29/1409
USPC ..... 404/25, 26
See application file for complete search history.

(56) References Cited

U.S. PATENT DOCUMENTS 1,639,495 A * 8/1927 Frame ..... E02D 29/1409 210/533
4,650,365 A * 3/1987 Runnels ..... E02D 29/14 404/25
5,044,818 A * 9/1991 Pritchard ..... E02D 29/1409 404/25
5,081,802 A * 1/1992 Westhoff ..... B28B 7/168 404/26
5,201,151 A * 4/1993 LeBlanc ..... E02D 29/1427 404/25
5,360,131 A * 11/1994 Phillipps ..... E02D 29/1409 220/3.7
5,511,897 A * 4/1996 House ..... E02D 29/12 156/71
5,775,835 A * 7/1998 Szekely ..... E01O 5/20 104/30
5,899,024 A * 5/1999 Stannard ..... E02D 29/1409 404/26

(Continued)

*Primary Examiner* — Gary S Hartmann
(74) *Attorney, Agent, or Firm* — Wood, Phillips, Katz, Clark & Mortimer

(57) ABSTRACT

A method of forming an upwardly facing surface around a conduit that is embedded in ground material and defines a passageway. The conduit has an open upper end, through which access can be gained to the passageway, and an outer perimeter. The method includes the steps of: obtaining a riser assembly; placing the riser assembly in operative relationship with the open upper end of the conduit wherein the riser assembly is supported at least partially by the ground material around the outer perimeter of the conduit and defines an entry opening to the passageway; and with the riser assembly in the operative relationship with the open upper end of the conduit, forming at least one material around the conduit to a desired vertical thickness on which the upwardly facing surface is defined.

22 Claims, 16 Drawing Sheets

(56) References Cited

U.S. PATENT DOCUMENTS

| | | | | |
|---|---|---|---|---|
| 6,179,518 | B1 * | 1/2001 | Suatac | E02D 29/1409 404/26 |
| 6,457,901 | B1 * | 10/2002 | Sondrup | E02D 29/1445 404/25 |
| 6,709,191 | B1 * | 3/2004 | McCuskey | A61H 3/066 404/19 |
| 6,851,225 | B1 * | 2/2005 | Haar | E02D 29/1409 404/25 |
| 7,347,644 | B2 * | 3/2008 | Meyers | E02D 29/12 404/25 |
| 8,182,171 | B2 * | 5/2012 | Poulsen | E01C 11/227 404/26 |
| 8,858,114 | B2 * | 10/2014 | Gaspar | E02D 29/12 404/25 |
| 2002/0150424 | A1 * | 10/2002 | Brodeur | E02D 29/1409 404/26 |

* cited by examiner

METHOD FOR FORMING A SURFACE AROUND AN EMBEDDED CONDUIT

BACKGROUND OF THE INVENTION

Field of the Invention

This invention relates to embedded conduits as used to provide above-ground access to a valve, or the like, that is below ground and, more particularly, to a method for forming exposed upper surfaces around access regions of the conduits.

Background Art

Conduits are used at many different locations to provide above-ground access to different below ground components, such as valve actuators or switches associated with utility supplies, or other components that may control delivery of different consumable resources to residences and/or businesses. These conduits may be embedded in ground material on private property, in parkways, and/or on public roadways.

Embedded conduits on public roadways present a particular challenge, both at the time when the roadway is initially surfaced and when it is re-surfaced and/or repaired. Resurfacing of roadways with asphalt generally results in an end product wherein the upper surface is raised. In one typical process, the initial step of resurfacing involves removing a predetermined thickness of the existing asphalt through a milling process to create a generally level grade prior to application of a new asphalt layer. Different designs have been devised for these conduit systems that allow them to be adapted to a raised upper roadway surface.

In one form, the upper region of the conduit is provided with an access assembly having a diameter enlarged relative to the diameter of a main conduit portion that defines an access passageway extending from above ground to the particular operating site underground. A removable cover, generally intended to be substantially flush with grade when installed, is provided as part of the access assembly. The conduit consists of threadably engaged parts which can be turned relative to each other in opposite directions around a vertical axis to effectively raise and lower the height of an upper edge of the access assembly at which the cover is located.

The above design, while conceptually sound, often becomes inoperable or impractical because of the nature of the material making up its parts. Typically, the threadably engaged parts and the cover are made from cast iron. These parts may be immersed in water, in some environments at almost all times. As a result, the parts are prone to rusting and corroding. This may cause the parts to fuse to the point that when attempts are made to relatively turn the threaded parts, the operator may be unable to do so. Alternatively, large torques applied to the threaded parts may cause a failure at one or more locations along the conduit. In a worst case, torquing of the parts may cause a failure of an underground valve, or the like. Any of the above results could result in a time-consuming and potentially expensive repair. In a worst case, the conduit assembly may have to be unearthed to gain access to an underground component being controlled.

As an alternative to this design, it is known to provide a collection of extension sleeves that nest in components on existing access assemblies. The sleeves are offered with different vertical dimensions to accommodate different anticipated degrees of thickening for the surface layer. The sleeves are configured to accommodate the existing covers. Accordingly, changing the construction of an existing access assembly involves removing the cover, installing an appropriately dimensioned sleeve, and replacing the cover on the selected sleeve.

The primary drawback with the latter system is that extension sleeves are held in place primarily by the newly applied asphalt layer. Thus, care has to be taken in compacting the asphalt around the sleeves during resurfacing to make certain the asphalt is tightly compacted against and conformingly around the sleeve. This may require a separate manual process carried out with individual hand tools. Further, regardless of how the compaction is effected, the extension sleeves are prone to being engaged and released by vehicles traveling over the surface. This is particularly a problem when the surface is being treated as by blades on snow removal equipment.

Generally, a number of the above problems, while particularly prevalent during resurfacing, are contended with at the time of initial construction. Given that viable solutions to the above problems are not known to exist, the industry has contended with those problems which, aside from causing inconvenience, potentially represent a danger. For example, the extension sleeves and associated cover, once separated, may remain loose on road surfaces and prone to being struck, and potentially propelled, by vehicular traffic.

Accordingly, there continues to exist a need to devise a practical system that addresses some or all of the above-identified problems.

SUMMARY OF THE INVENTION

In one form, the invention is directed to a method of forming an upwardly facing surface around a conduit that is embedded in ground material and defines a passageway. The conduit has an open upper end through which access can be gained to the passageway and an outer perimeter. The method includes the steps of: obtaining a riser assembly; placing the riser assembly in operative relationship with the open upper end of the conduit wherein the riser assembly is supported at least partially by the ground material around the outer perimeter of the conduit and defines an entry opening to the passageway; and with the riser assembly in the operative relationship with the open upper end of the conduit, forming at least one material around the conduit to a desired vertical thickness on which the upwardly facing surface is defined.

In one form, the ground material consists of an asphalt layer, a compacted gravel layer underlying the asphalt layer, and a road base layer underlying the compacted gravel layer. The step of placing the riser assembly in operative relationship with the open upper end of the conduit involves placing a downwardly facing surface on the riser assembly against at least one of the compacted gravel and road base layers.

In one form, the conduit has a vertical central axis. The riser assembly has a ring-shaped component with a central axis. With the riser assembly in the operative relationship with the open upper end of the conduit, the vertical central axis of the conduit and central axis of the ring-shaped component are angled with respect to each other.

In one form, the riser assembly has a ring-shaped component with a ring-shaped portion that surrounds the outer perimeter of the conduit and bears upon the ground material with the riser assembly in the operative relationship with the open upper end of the conduit.

In one form, the conduit has a central axis and an annular upper edge. The step of obtaining a riser assembly involves Obtaining a riser assembly configured to define: a) a seat in which the annular upper edge of the conduit seats with the riser assembly in the operative relationship with the upper end of the conduit; and b) a curved portion that extends around the outer perimeter of the conduit and bears against the ground material with the riser assembly in operative relationship with the upper end of the conduit.

In one form, the open upper end of the conduit has radially oppositely facing annular surfaces. The seat has an inverted "U" shape in cross section bounded by a surface. With the riser assembly in the operative relationship with the open upper end of the conduit, separate portions of the surface bounding the seat face each of the radially oppositely facing annular surfaces on the open upper end of the conduit.

In one form, the riser assembly has an annular body with a central axis. A flange projects radially outwardly from the body and defines the curved portion of the riser assembly.

In one form, the seat is defined on the annular body. The flange extends fully around the outer perimeter of the conduit.

In one form, the flange has at least one elongate, fully surrounded opening therethrough. The step of forming the at least one material involves directing the at least one material into the fully surrounded opening.

In one form, the step of obtaining a riser assembly involves providing a riser assembly made from a non-metal material.

In one form, the step of obtaining a riser assembly involves obtaining a riser assembly wherein the annular body is molded from a urethane material.

In one form, the step of obtaining a riser assembly involves selecting a riser assembly from a plurality of riser assemblies having different vertical dimensions based on a particular site condition.

In one form, the step of obtaining a riser assembly involves obtaining a riser assembly with a ring-shaped component with a central axis. The ring-shaped component has a radially outwardly projecting flange. The step of forming at least one material involves forming the at least one material against the radially outwardly projecting flange.

In one form, the at least one material is at least one of mortar, concrete and another flowable and settable material that hardens.

In one form, the at least one material is asphalt.

In one form, with the riser assembly in operative relationship with the open upper end of the conduit, an upper entry opening to the passageway is defined. The method further includes the steps of obtaining a cap assembly and placing the cap assembly in operative relationship with the conduit and riser assembly so that the cap assembly blocks the upper entry opening.

In one form, the cap assembly and riser assembly are made from materials and configured so that non-metal portions of the cap assembly and riser assembly interact to maintain the cap assembly in the operative relationship with the conduit and riser assembly.

In one form, the step of placing the cap assembly in the operative relationship with the conduit and riser assembly involves snap fitting the cap assembly to the riser assembly.

In one form, the cap assembly, riser assembly, and conduit are configured so that the cap assembly extends fully through the riser assembly and into the passageway with the cap assembly in the operative relationship with the conduit and riser assembly.

In one form, the method further includes the step of removing ground material from around a pre-embedded conduit before placing the riser assembly in the operative relationship with the upper end of the conduit.

DETAILED DESCRIPTION OF THE PREFERRED EMBODIMENT

Figure 1:
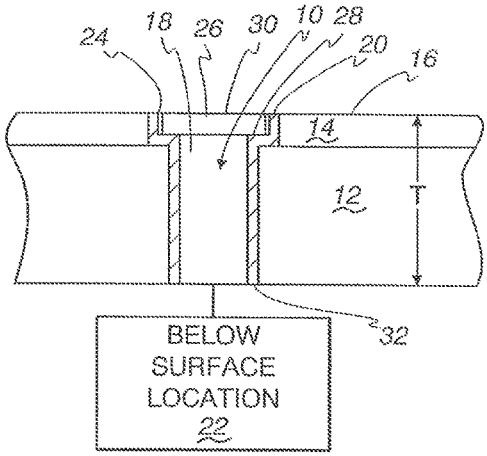
Fig. 1 (Prior Art)
FIG. 1 is a partially schematic, cross-sectional view of a conventional roadway having a known form of conduit directed therethrough and embedded in ground material to access a below surface location and with a releasable cover over an access opening at the top of the conduit.

In FIG. 1, a typical, exemplary environment for the present invention is depicted. A conduit 10 is embedded in ground material having a composite thickness T, typically made up of at least one compacted base/sub-surface layer 12 upon which one or more layers 14 (one shown) are provided to define an exposed, upwardly facing surface 16. The layer 14 may be asphalt, concrete, or other material that produces a hard roadway surface 16 over which vehicles can conveniently travel. However, the invention contemplates accommodating conduits 10 that may be used on private property, on parkways, etc., that may be adjacent designated travel routes, or in areas subject to only foot travel or where no significant volume of traffic is contemplated.

The conduit 10 defines a passageway 18 that communicates between an open upper end 20 and a below surface location 22. Virtually any type of structure may be accessed at the below surface location 22. For example, there might be a valve, switch, or other type structure associated with a utility. Alternatively, the structure could be something controlled by a business, that is not a public utility, or by a private property owner. Examples of such structures are shown in pending U.S. patent application Ser. Nos. 13/999,276, 13/999,277, and 13/999,278, the disclosures of which are incorporated herein by reference. However, it should be understood that these structures are exemplary in nature only and should not be viewed as limiting.

In the depicted schematic disclosure in FIG. 1, a top entry/access opening 24 is selectively blocked by a cover/cover assembly 26, in this case in the form of a single plate. One exemplary cover assembly is shown in U.S. Pat. No. 8,375,551, entitled "Method for Covering An Above Ground Access Opening To A Conduit Assembly", the disclosure of which is incorporated by reference. The cover 26 bears against a step 28 defined where the diameter of the passageway 18 is enlarged. The cover 26 has a top surface 30 that is substantially flush with the upwardly facing surface 16 with the cover 26 operatively positioned. The cover 26 and conduit 10 are configured so that the cover 26 can be released to selectively access the passageway 18 through the top opening 24. A bottom 32 of the conduit 10 defines an outlet for the passageway 18 through which a particular component is accessed at the below surface location 22.

Figure 2:
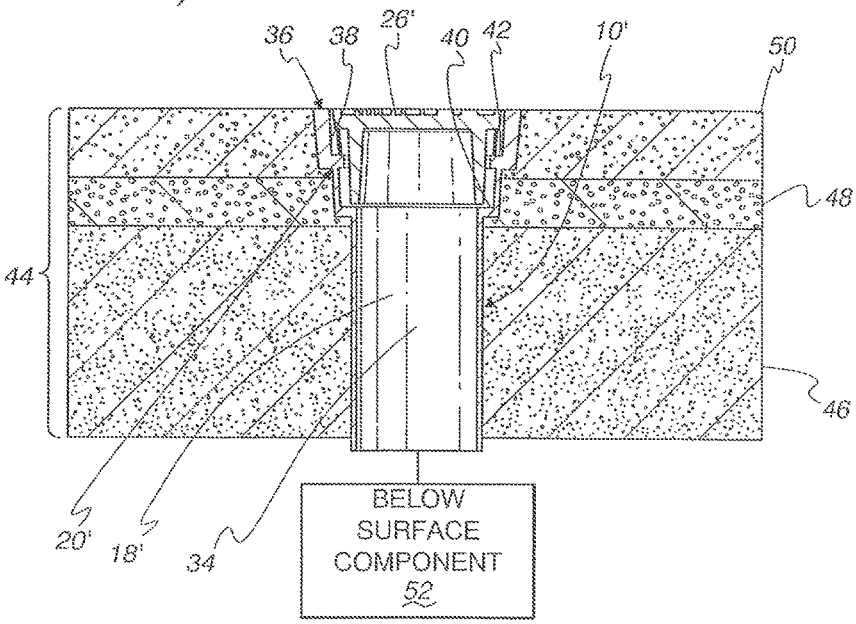
Fig. 2 (Prior Art)
FIG. 2 is a cross-sectional view, corresponding to that in FIG. 1, and showing one specific form of conventional conduit in a pre-existing roadway with a top asphalt layer.
Figure 3:
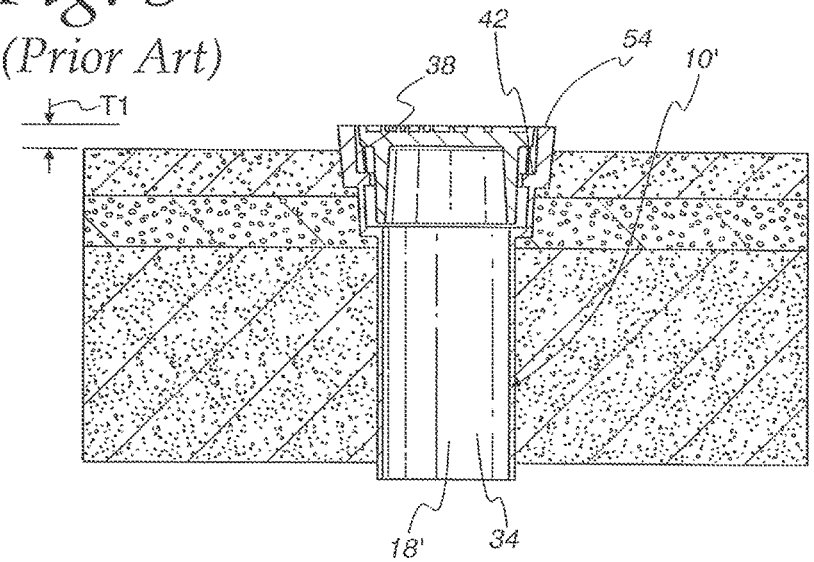
Fig. 3 (Prior Art)
FIG. 3 is a view as in FIG. 2 with an exposed portion of the asphalt layer milled to reduce its thickness.
Figure 4:
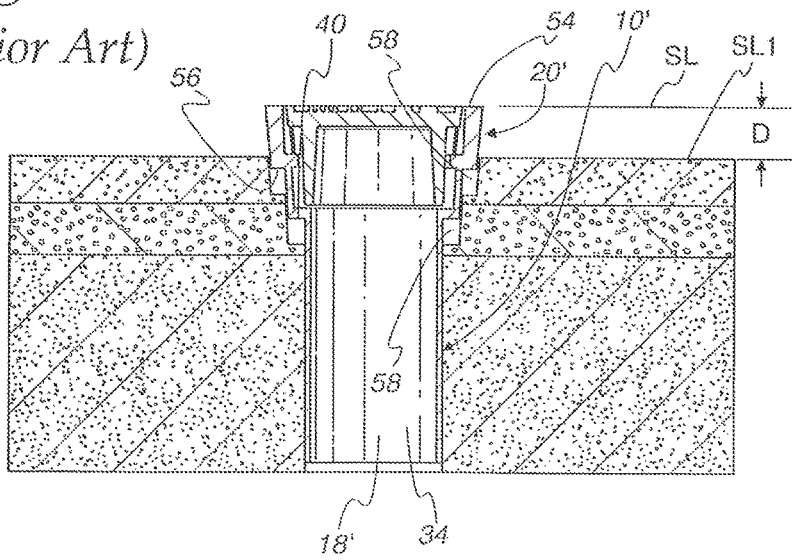
Fig. 4 (Prior Art)
FIG. 4 is a view as in FIG. 3 wherein the conduit has been raised to be flush with the top surface of a finishing asphalt layer.
Figure 5:
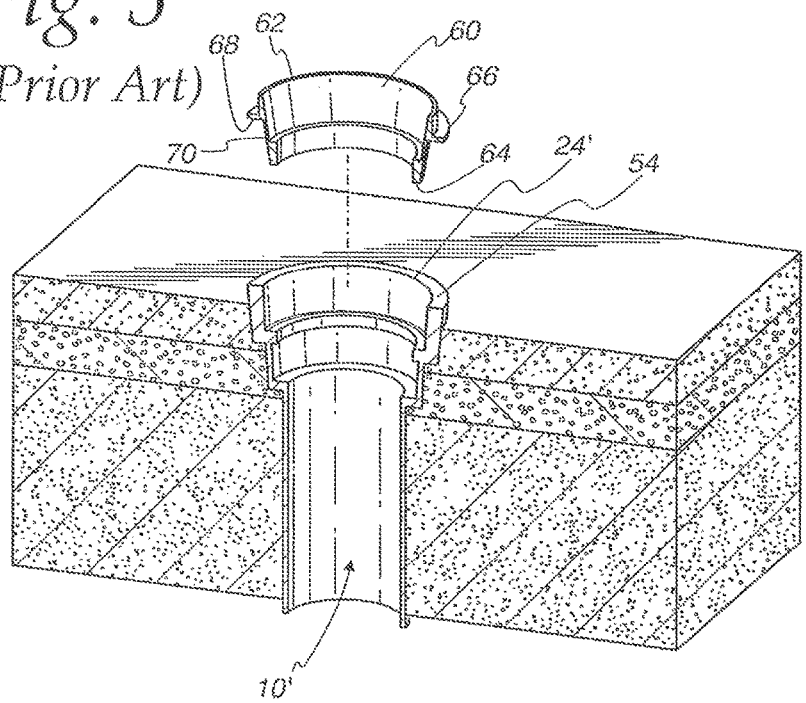
Fig. 5 (Prior Art)
FIG. 5 is an exploded perspective view of a section of a pre-existing conventional roadway with a known form of conduit embedded therein, a portion of an asphalt layer milled to be reduced in thickness, and a conventional cast iron riser ring in a pre-assembly position relative to the conduit.
Figure 6:
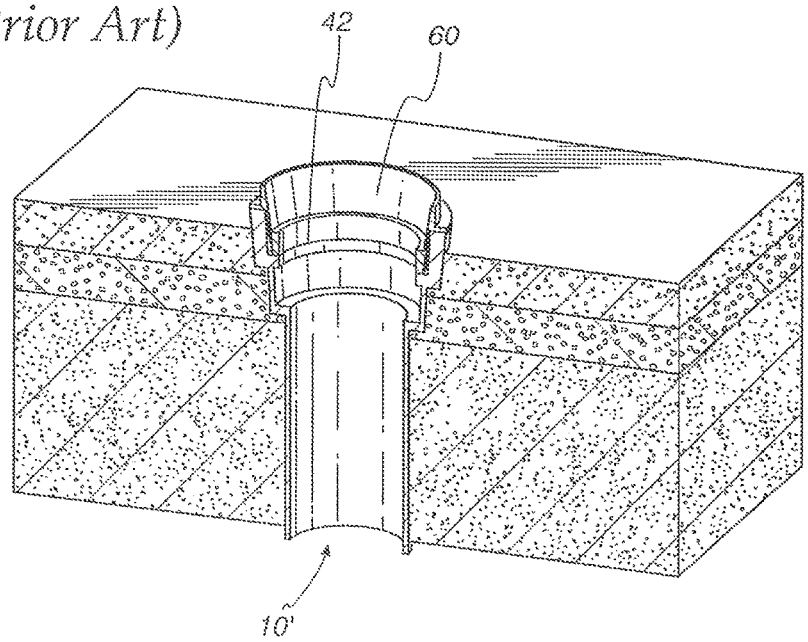
Fig. 6 (Prior Art)
FIG. 6 is a view as in FIG. 5 with the riser ring installed on the conduit.

One existing conduit construction is shown at 10' in FIGS. 2-4. The conduit 10' consists of a main conduit length 34 bounding a passageway 18'. The conduit 10' has an open upper end at 20' defined by an access assembly at 36. The access assembly 36 is constructed to define a stepped internal diameter bounded by a surface 38 above the main conduit length 34. Vertically spaced steps 40, 42 can individually or cooperatively bear against an operatively positioned cover 26' to maintain the same in that position.

In the depicted construction, ground material at 44, in which the conduit 10' is embedded, is made up of a road base layer 46 to which a road bed layer 48 is applied. The road bed layer 48 will typically be a compacted gravel material. Atop the road bed layer 48, one or more asphalt layers 50 are applied. In this embodiment, a single asphalt layer 50 is depicted for simplicity. The embedded conduit 10' permits the passageway 18' to be used to gain access to any below surface component 52. The particular depth of the below surface component 52 is not critical to the teachings herein.

Formation of an asphalt layer around the conduit 10', as depicted in FIGS. 2-4, will be described herein as part of a resurfacing operation. Starting with the completed and existing installation as shown in FIG. 2, a thickness T1 of the asphalt layer 50 is removed, as through a known milling operation, to produce the FIG. 3 state. The amount of asphalt removed depends upon the construction and condition of the road surface and will typically be in the range of 1-3 inches. However, this dimension is not critical.

Since typically resurfacing will apply a new thickness of asphalt greater than the thickness of the asphalt layer removed, provision must be made to accommodate the additional asphalt thickness. As shown in FIG. 4, part or all of the conduit 10' is repositioned and/or reconfigured to elevate the top edge 54 of the open upper end 20' to reside flush with the intended final height of the upwardly facing surface layer of the added asphalt layer, as indicated at SL in FIG. 4. The location SL is spaced above the location at SL1, to which the existing asphalt is milled, a distance D that is greater than T1 (FIG. 3).

The conduit 10' can be made with threadably engaged parts that define the conduit 10' itself, a connecting structure between the conduit 10' and the below surface component 52, or structure associated with the below surface component 52. By loosening these threaded parts, the top edge 54 can be elevated to the level identified at SL.

Since conventionally all of the parts that are threadably connected to permit this height variation for the top edge 54 are made from metal, and typically cast iron, the metal-to-metal regions may become fixed through the generation of rust and corrosion over time. Thus, as described above, there may be some difficulty unthreading the portion of the conduit 10' or the entirety of the conduit 10', to allow elevation of the top edge 54. This may complicate on-site operations and, as described above, could potentially lead to failure of one or more parts on the conduit 10' and/or a structure associated with the conduit 10'.

If the raising of the open upper end 20' of the conduit 10' can be effected, the stepped outer surface 56 at the open upper end 20', by reason of its vertical repositioning, causes separate annular voids 58 to be formed at vertically spaced locations. It may be difficult, or impossible, to force asphalt, or any other ground material, into these voids 58 as the asphalt is applied between the surface level SL1 formed by the asphalt removal, and the desired level of the final, upwardly facing surface at SL. As a consequence, the conduit upper end 20' may be immediately, or progressively, depressed downwardly towards or into its original height, as permitted by the voids 58, under potentially heavy vehicular traffic. This creates a depression resulting from the top edge 54 residing below the height of the final, upwardly facing surface layer at SL. This depression tends to accumulate moisture and also may create an irregularity that may be sensed by occupants of vehicles traveling thereover.

An alternative system currently utilized to accommodate elevation of a road surface after resurfacing thereof is shown in FIGS. 5-12. In FIGS. 5-12, the same conduit 10', as shown in FIGS. 2-4, is utilized. Riser rings 60 are selectively utilized to form a top edge 62 on the conduit 10' that is above the top edge 54. The riser rings 60 are made with different heights, typically in 1-6 inch increments, to accommodate additional thicknesses of an asphalt layer applied during resurfacing and potential conduit settling.

The riser ring 60 has a bottom edge 64 facing oppositely to the top edge 62. Between the top and bottom edges 62, 64, a radially out-turned flange 66 is defined. The riser ring 60 is configured so that an annular, downwardly facing surface 68 on the flange 66 abuts to the top edge 54 simultaneously as the bottom edge 64 abuts to the step 42 on the conduit 10' as the riser ring 60 realizes its assembled/operative position. With the riser ring 60 initially in a separated state, the portion of the ring 60 beneath the flange 66 can be directed through the top entry/access opening 24' until the flange 66 seats against the top edge 54. The outer surface 70 of the riser ring 60 beneath the flange 66 has a tapered construction to facilitate its funnelling into the top entry/access opening 24'.

Figure 7:
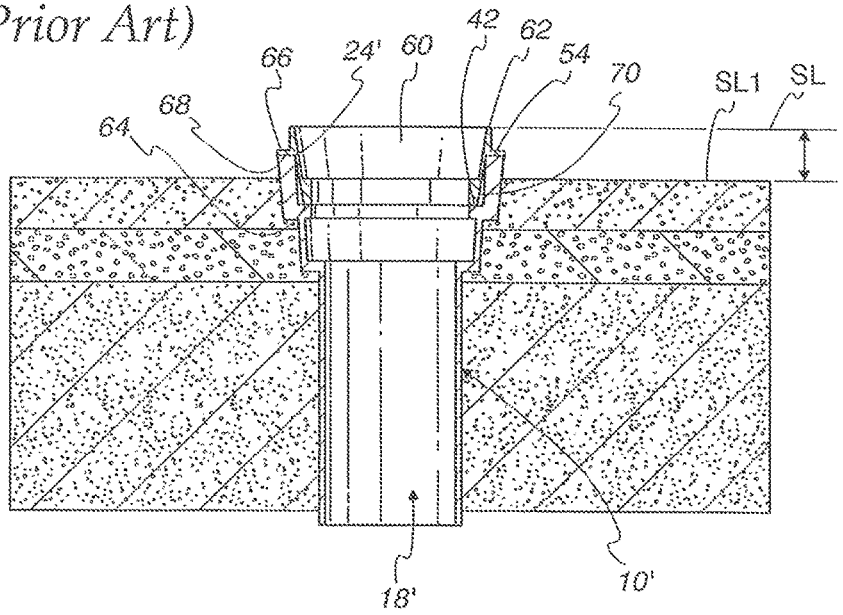
Fig. 7 (Prior Art)
FIG. 7 is a view of the components as shown in FIG. 6 but from a different perspective.
Figure 8:
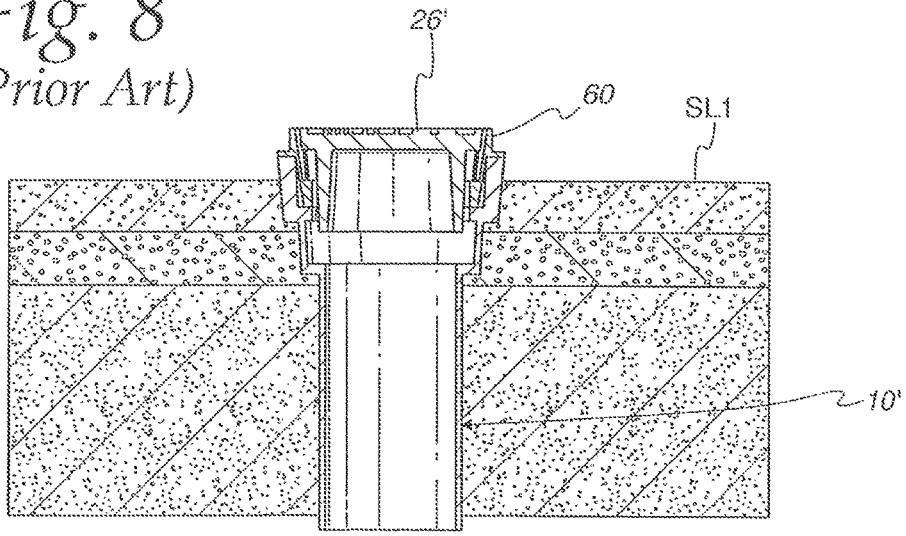
Fig. 8 (Prior Art)
FIG. 8 is a view as in FIG. 6 with a conduit cover in place.
Figure 9:
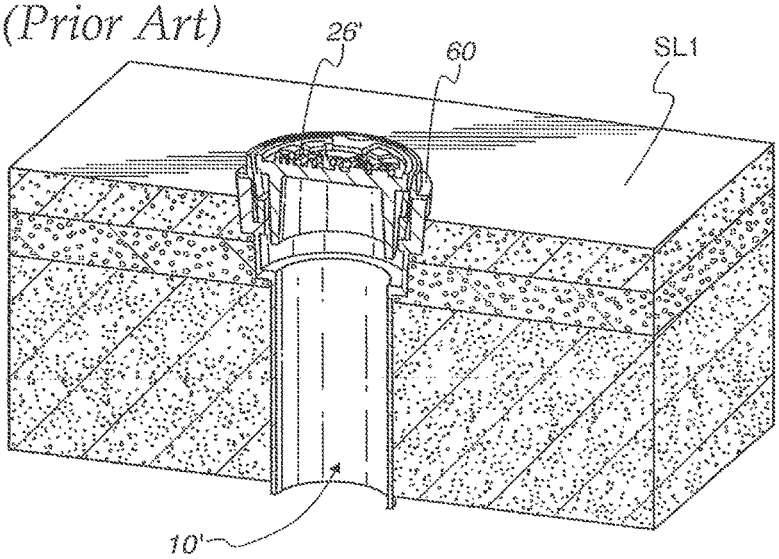
Fig. 9 (Prior Art)
FIG. 9 is a view of the components as in FIG. 8 but from a different perspective.

The riser ring 60 is constructed so that the top edge 62 will coincide with the intended final height of the exposed, upwardly facing surface on the applied asphalt layer at SL. As described above, the step of removing a partial thickness of the existing asphalt will lower the surface height to the level SL1. This state is shown in FIGS. 7-9.

Figure 10:
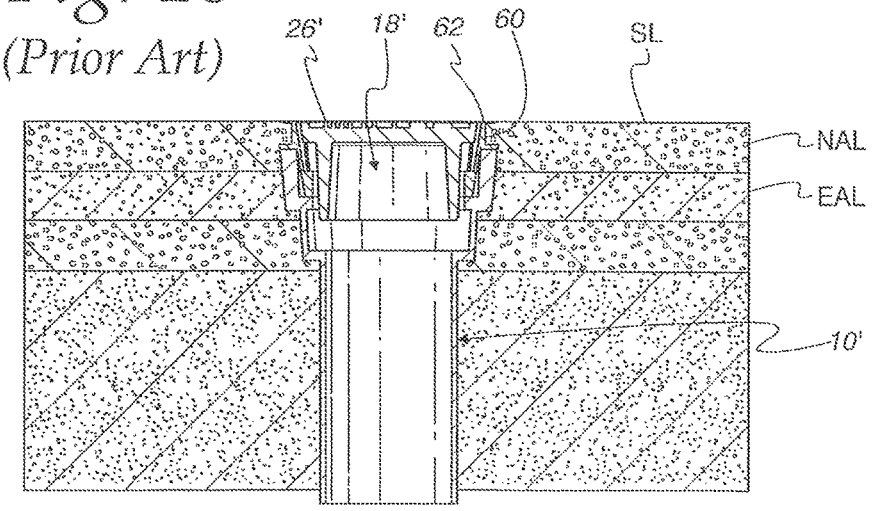
Fig. 10 (Prior Art)
FIG. 10 is a view as in FIG. 8 with a finishing layer of asphalt applied.
Figure 11:
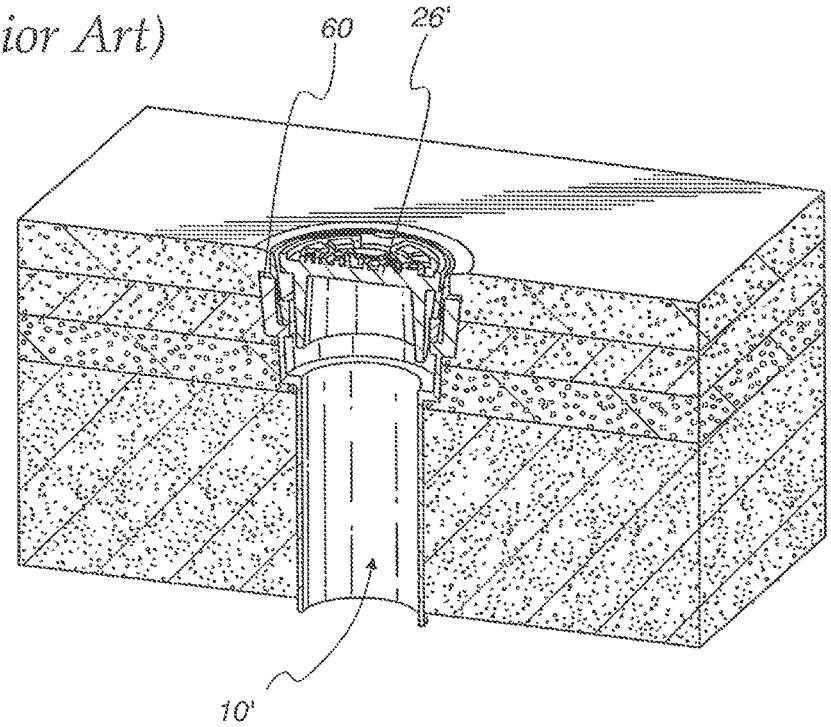
Fig. 11 (Prior Art)
FIG. 11 is a view of the components as in FIG. 10 but from a different perspective.
Figure 12:
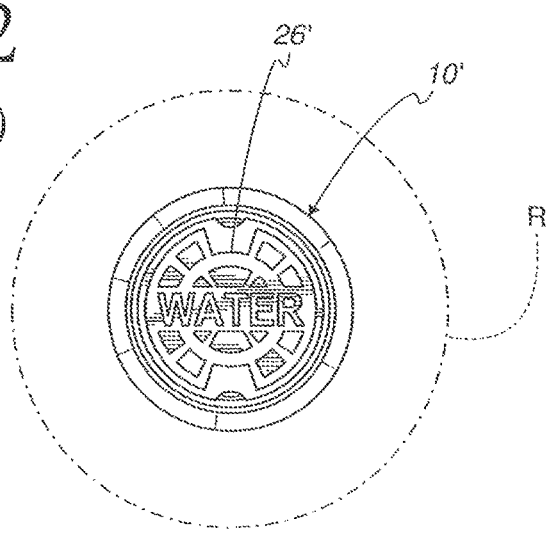
Fig. 12 (Prior Art)
FIG. 12 is a plan view of a section of the roadway in the state shown in FIGS. 10 and 11.

Thereafter, the new asphalt layer NAL, applied to the existing asphalt layer EAL, will create a finished, exposed upwardly facing surface layer SL that is flush with the flange edge 62, as seen in FIGS. 10-12.

Since the riser ring 60 is prone to having one location drawn upwardly out of the passageway 18' by a downward force at a diametrically opposite location, it is common to hand compact the asphalt around the perimeter of the riser ring 60 before heavy asphalt compacting machinery is utilized. The critical region is that within the circle R in FIG. 12. This introduces a certain amount of inconvenience and also may result in less than an adequately tight compaction of the added asphalt around the riser ring 60. Further, since the riser ring 60 is maintained in its operative position primarily by the added asphalt layer NAL, even with recommended steps being precisely carried out, there is still a tendency of the riser ring 60 to break free after resurfacing is concluded when subjected to heavy downward loads and scraping, as by plow blades. This problem is aggravated by the fact that the cover 26' is supported by the riser ring 60 and will thus separate therewith. Accordingly, both the riser ring 60 and cover 26' could become potentially dangerous, loose articles existing on roadways where vehicular traffic may be moving at high speeds.

A method of forming an upwardly facing surface around a conduit, such as the conduit 10', according to the present invention, is shown in FIGS. 13-31 for an existing, paved roadway. The conduit 10' is shown embedded in the ground material 44 made up of the exemplary road base layer 46, road bed layer 48, and one or more asphalt layers 50. The precise composition of the ground material 44 is not critical to the present invention. However, as described above, the embedded conduit 10' is designed so that the top edge 54 at the open upper end 20' of the conduit 10' is flush with the top-most/exposed, upwardly facing road surface 72. It should be understood that the surface 72 may result from an original installation or from a resurfacing process. The method will be described hereinbelow with respect to a resurfacing operation.

Figure 13:
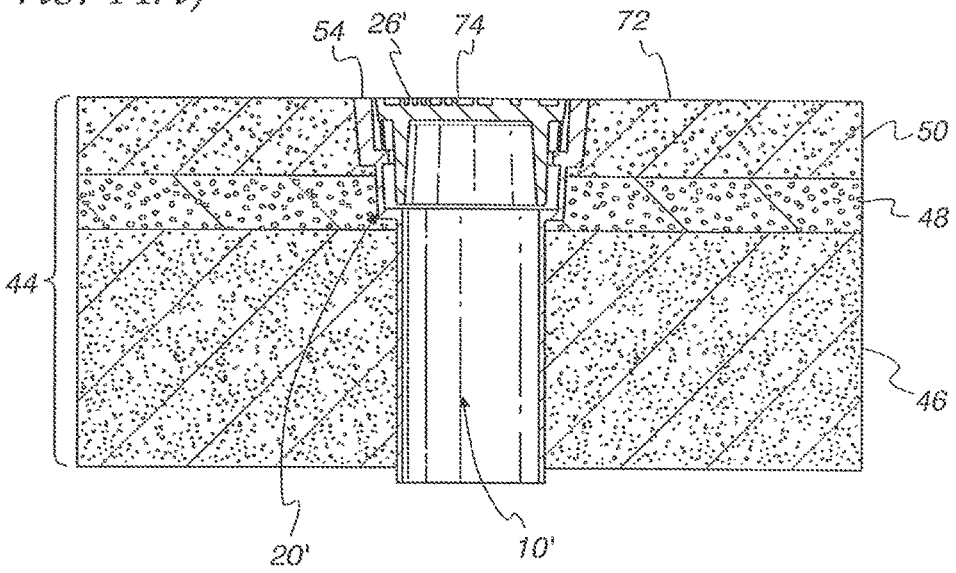
Fig. 13 (Prior Art)
FIG. 13 is a cross-sectional view of a pre-existing roadway with a conduit and cover assembly of known construction.
Figure 14:
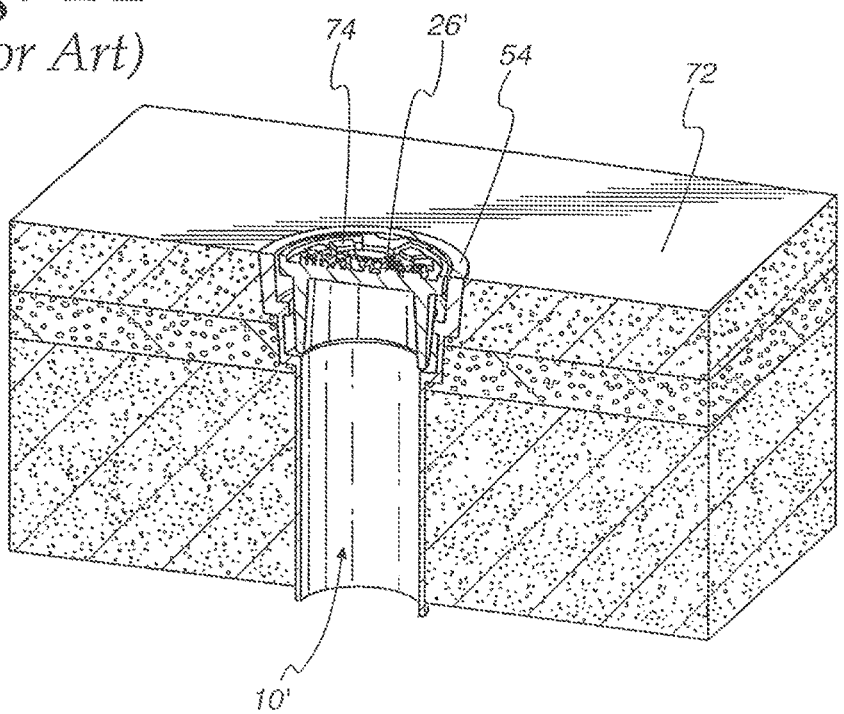
Fig. 14 (Prior Art)
FIG. 14 is a view of the components as in FIG. 13 but from a different perspective.

Initially, with the conduit 10' embedded in an existing asphalt roadway as shown in FIGS. 13 and 14, the top edge 54 of the conduit 10' and an upwardly facing surface 74 on the cover 26' are both nominally flush with the surface 72.

Figure 15:
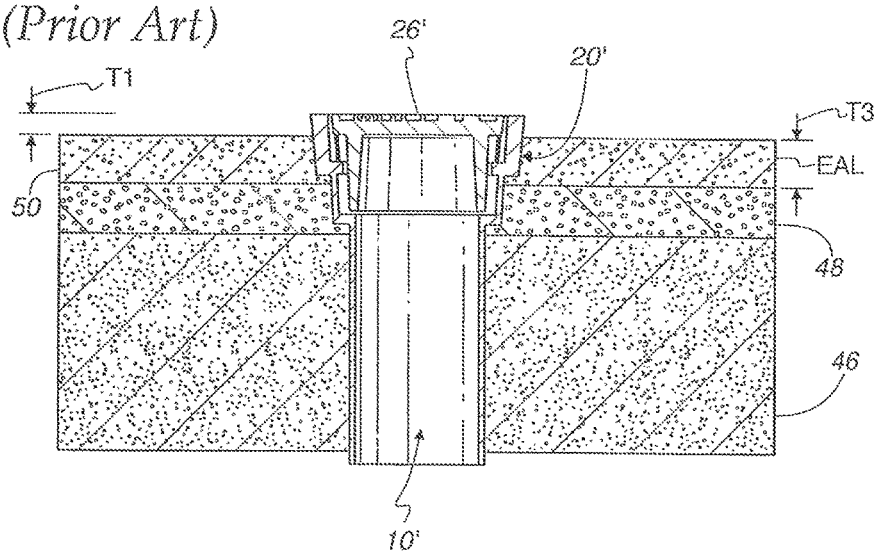
Fig. 15 (Prior Art)
FIG. 15 is a view as in FIG. 13 with an exposed portion of an asphalt layer removed through a milling operation.
Figure 16:
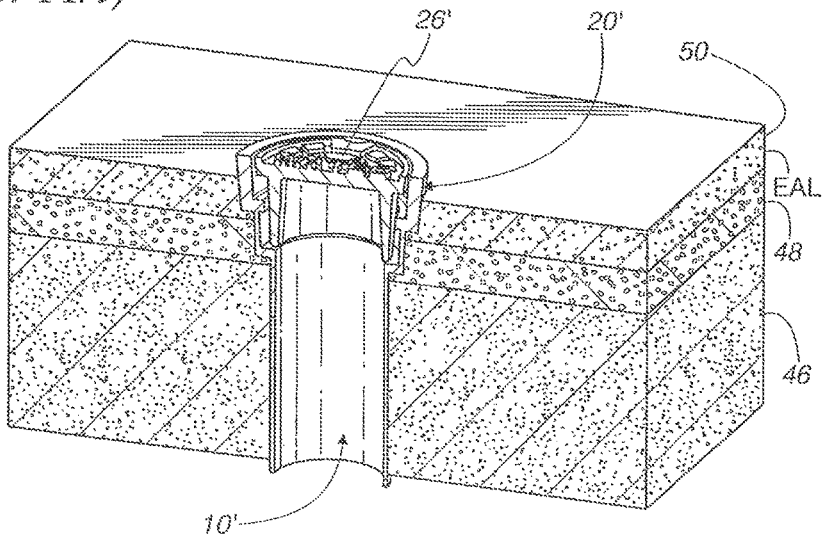
Fig. 16 (Prior Art)
FIG. 16 is a view of the components as in FIG. 15 but from a different perspective.

As shown in FIGS. 15 and 16, the asphalt layer(s) 50 is/are milled in a step preparatory to re-application of asphalt. The amount of asphalt removed depends upon the construction and the condition of the road surface, and will typically in the range of 1-3 inches, as indicated by the thickness T1 in FIG. 15. This leaves intact a thickness T3 of the existing asphalt layer(s) 50 (EAL).

Figure 17:
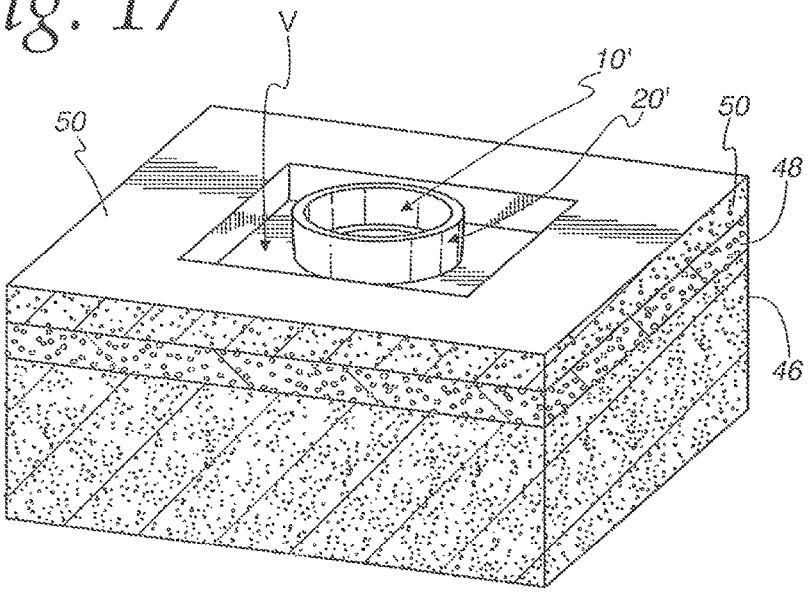
FIG. 17 is a view as in FIG. 16 wherein a cutout has been made, according to the invention, to produce a void around the conduit.
Figure 18:
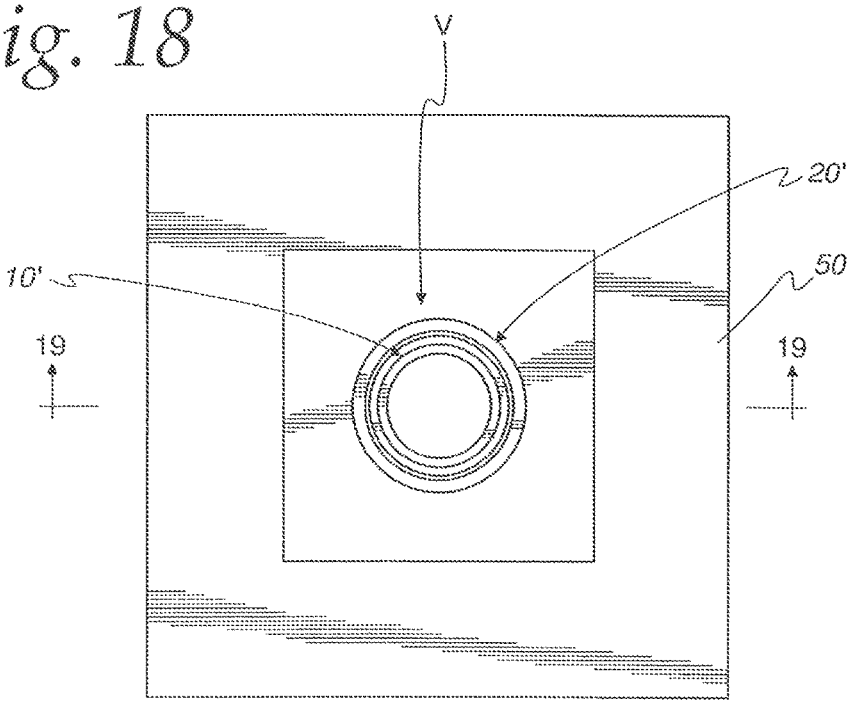
FIG. 18 is a plan view of the components as in FIG. 17.
Figure 19:
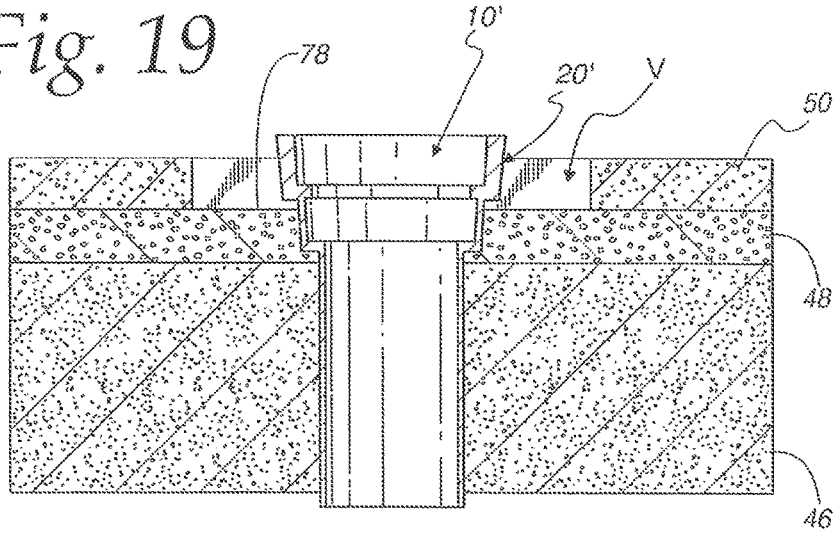
FIG. 19 is a cross-sectional view of the highway section and conduit taken along line 19-19 of FIG. 18.
Figure 20:
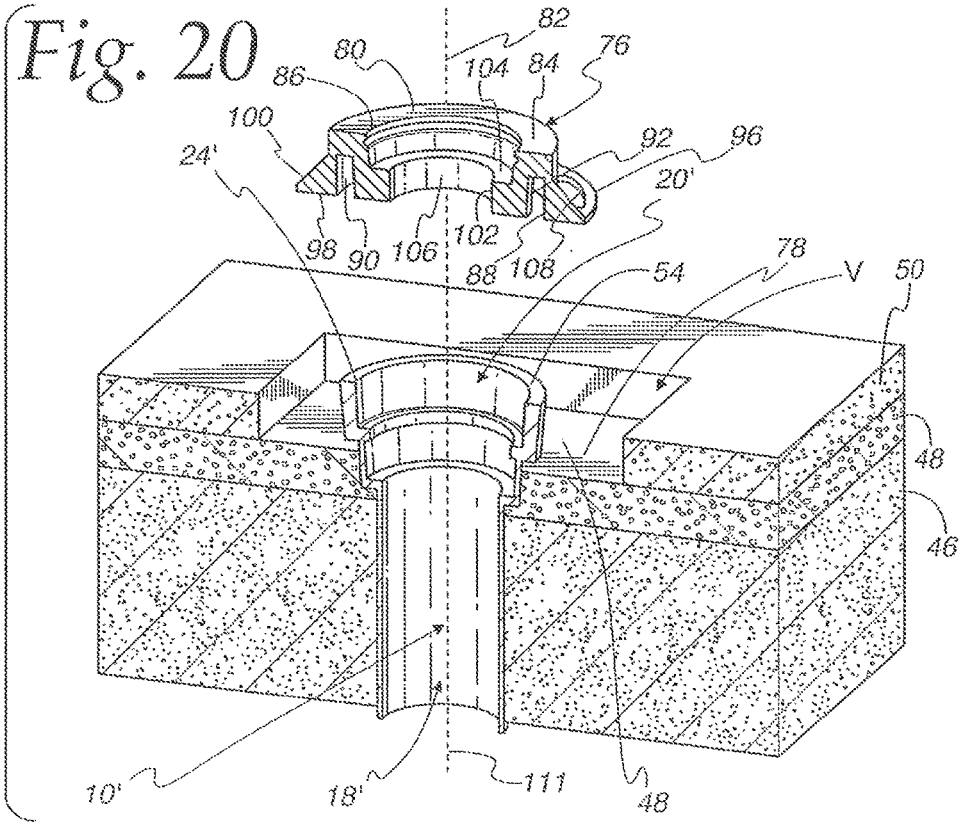
FIG. 20 is a view of the components as in FIG. 19 but from a different perspective and showing a sectioned riser assembly, according to the present invention, in a pre-assembly position.
Figure 21:
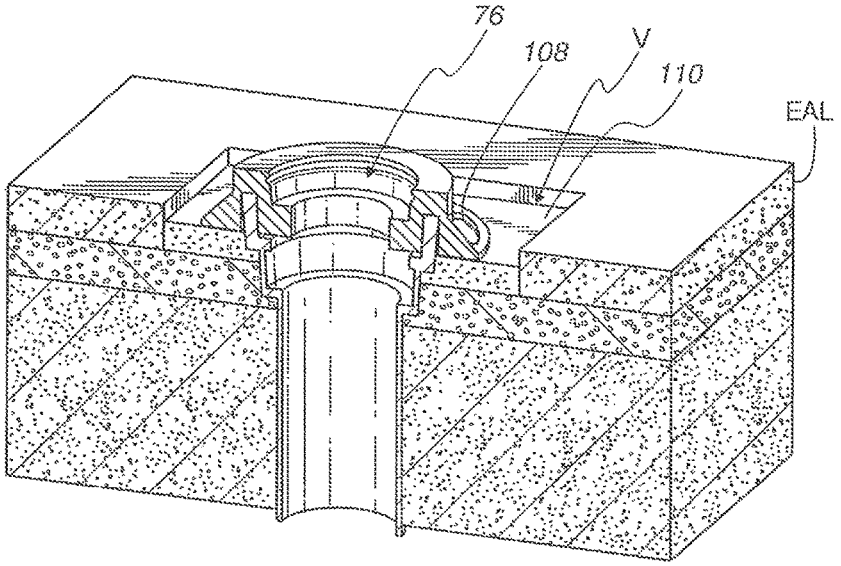
FIG. 21 is a view as in FIG. 20 with the riser assembly in operative relationship with the conduit.
Figure 22:
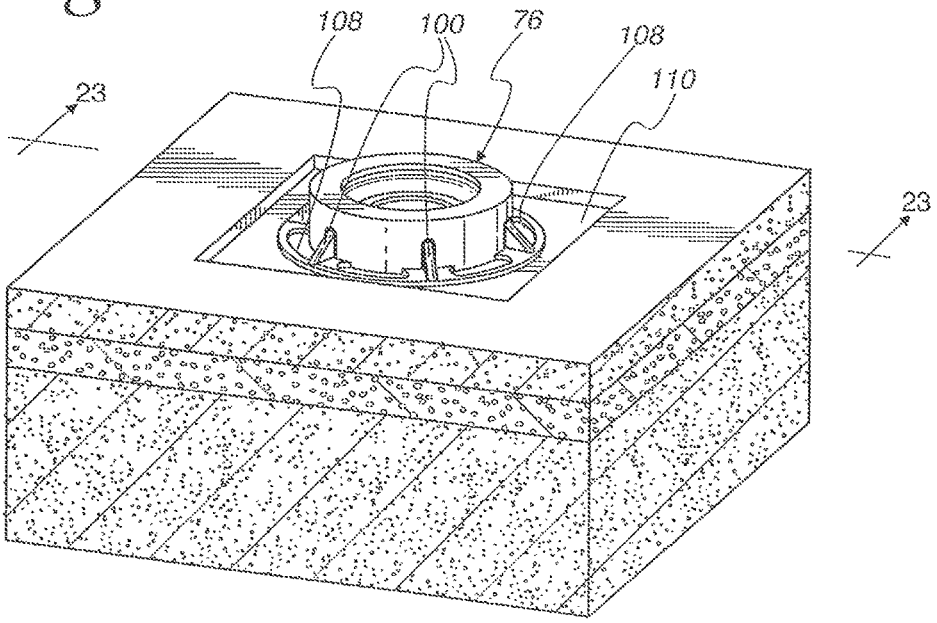
FIG. 22 is a view as in FIG. 21 showing the entire conduit and riser assembly.

As shown in FIGS. 17-19, a volume of asphalt in the remaining layer making up the thickness T3 is removed around the perimeter of the open upper end 20' of the conduit 10' to form a void V around the conduit 10'. Removal of the entire remaining asphalt thickness T3 around the perimeter of the conduit 10' exposes the road bed layer 48, which is typically gravel, at the bottom of the void V. The precise shape of the void V produced by the asphalt removal is not critical. As depicted, a square cutout is made with each side on the order of 14-16 inches. Alternatively, a circular cutout may be produced or some other shape that may be conveniently formed may be selected to produce the void V.

As shown in FIGS. 20-31, a riser assembly at 76 is utilized. The riser assembly 76 may take a number of different forms. As depicted, the riser assembly 76 has a single piece that interacts with the open upper end 20' of the conduit 10' and bears on the exposed upwardly facing surface 78 on the gravel road bed layer 48 at the bottom of the void V. While the riser assembly 76 may have a significantly different construction than depicted, essentially what is desirable is that the riser assembly 76 be configured so that it interacts with the open upper end 20' of the conduit 10' so as to: a) not shift freely horizontally relative thereto and additionally; b) have a portion, preferably curved, that extends around part, and more preferably all, of the perimeter of the open upper end 20' of the conduit 10' to be supported at the road bed layer 48 with the riser assembly 76 in operative relationship with the open upper end 20' of the conduit 10', as shown in each of FIGS. 21-31.

As depicted, the riser assembly 76 has a ring-shaped, annular, main body 80 with a central axis 82 that extends vertically with the riser assembly 76 in its operative relationship with the open upper end 20' of the conduit 10'. With the riser assembly 76 in operative relationship with the open upper end 20' of the conduit 10', the riser assembly 76 defines a new top edge 84 for the conduit 10 above the top edge 54. It will be described below precisely how the location of the top edge 84 is arrived at. The main body 80 defines a top entry/access opening 86 around and above the top entry/access opening 24'. In other words, the opening 86 redefines the opening 24 through which access to the passageway 18' is gained from above ground.

It should be noted that the cut-out that forms the void V, while preferably formed fully through to the road bed layer 48, may terminate vertically in the asphalt layer 54 or in the road base layer 46. While preferably the riser assembly 76 bears against the road bed layer 48, regardless of the layer against which it bears, the underlying layer is preferably formed so that the top edge 84 can be levelled to reside in the plane of the desired final exposed, upwardly facing surface SL of the asphalt.

The main body 80 is configured to define an annular seat 88 that has an inverted "U" shape in cross-section. The surface bounding the seat 88 includes a radially inwardly facing annular surface portion 90, a radially outwardly facing annular surface portion 92, and an annular downwardly facing surface portion 94 connecting between the surface portions 90, 92.

A ring-shaped, annular flange 96 projects radially outwardly from the main body 80 and, in conjunction therewith, defines a downwardly facing bearing surface 98 that can be placed against the surface 78 in the road bed layer 48, or a surface in another one of the identified ground layers.

A plurality of reinforcing gussets 100 are spaced at regular intervals around the perimeter of the main body 80 and reinforce between the main body 80 and the flange 96.

With the riser assembly 76 in operative relationship with the open upper end 20' of the conduit 10', the open upper end 20' of the conduit 10 projects into the seat 88, preferably so that the surface portion 94 bounding the seat 88 bears against the upwardly facing edge 54 on the conduit 10'. As seen, the flange 96 surrounds the perimeter of the conduit 10' and main body 80. The main body 80 projects radially inwardly from the seat 88 to define an annular wall 102 with an upwardly facing annular surface 104 and bounding a vertical through opening 106.

Figure 24:
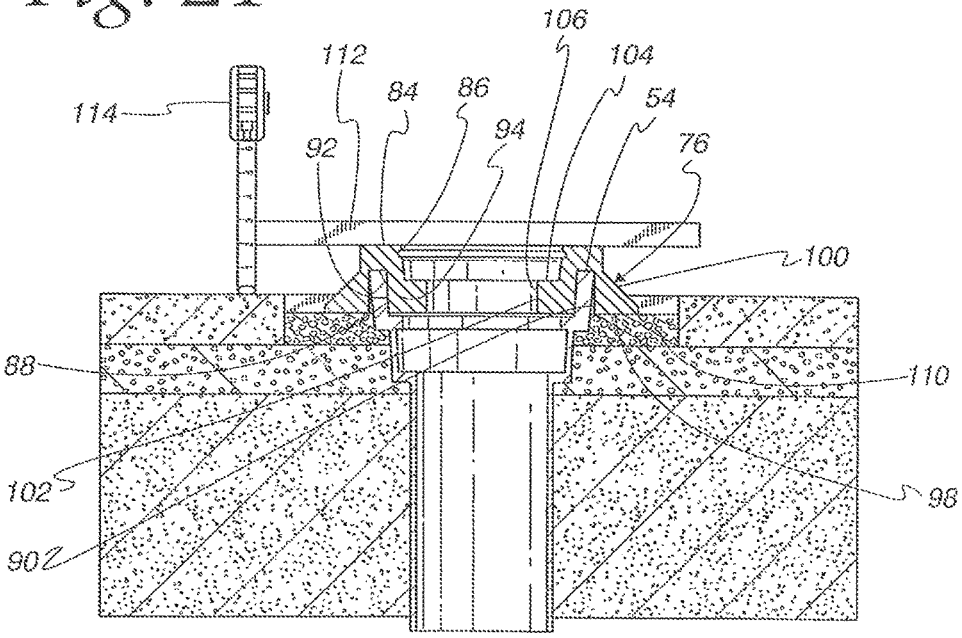
FIG. 24 is a view as in FIG. 23 and showing a measurement being taken of the height of the riser assembly.

As seen clearly in FIG. 24, with the riser assembly 76 in operative relationship with the conduit 10', a portion of the riser assembly 76 outside of the outer perimeter of the conduit 10' is in vertically overlapping relationship with the outer perimeter of the conduit 10', whereby a horizontal reference plane is capable of passing through the portion of the riser assembly 76 outside of the outer perimeter of the conduit 10' and the outer perimeter of the conduit 10'.

With this arrangement, the riser assembly 76 is supported at least partially by the ground material around the outer perimeter of the conduit 10'. More preferably, the riser assembly 76 is supported both by the conduit 10' and the ground material. Though preferred, it is not required that the flange 66 extend fully around the perimeter of the conduit 10'. For example, a curved flange portion, or multiple curved flange portions, may extend partially around the conduit perimeter to bear against the ground material.

To facilitate more positive securement of the flange 66, the flange 66 has at least one elongate, fully surrounded opening 108 into which the road bed layer 48, or potentially the road base layer 46, may extend. Alternatively, as described below, the resurfacing asphalt layer may extend into the opening(s) 108 to effect securement. As depicted, there are a series of the openings 108 spaced circumferentially around the flange 66.

Preferably, the flange 66 is covered by/embedded in a separate material 109, such as mortar, concrete, or other settable material, that can be poured into the void V to flow into the opening(s) 108 and harden to lock the flange 66 in place. The settable material defines a block that locks into the polygonally-shaped void V.

After the existing asphalt is milled and the cut-out formed to produce the void V for the riser assembly 76, the riser assembly 76 is placed in operative relationship with the open upper end 20 of the conduit 10', and levelled. This is achieved most readily against the road bed layer 48, which may be defined by gravel. In the event that the conduit 10' is skewed, this levelling may place the axis 82 of the main body 80 at a slight angle with respect to the central vertical axis 111 of the conduit 10'.

Figure 23:
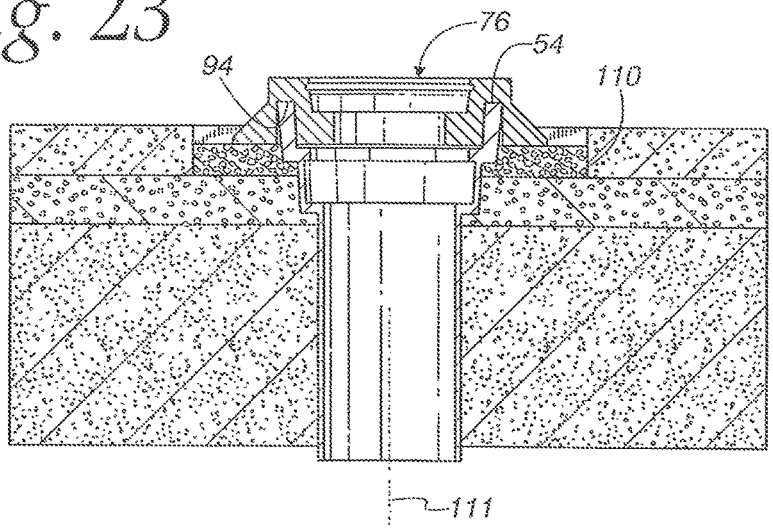
FIG. 23 is a cross-sectional view of the roadway, conduit, and riser assembly taken along line 23-23 of FIG. 22.
Figure 25:
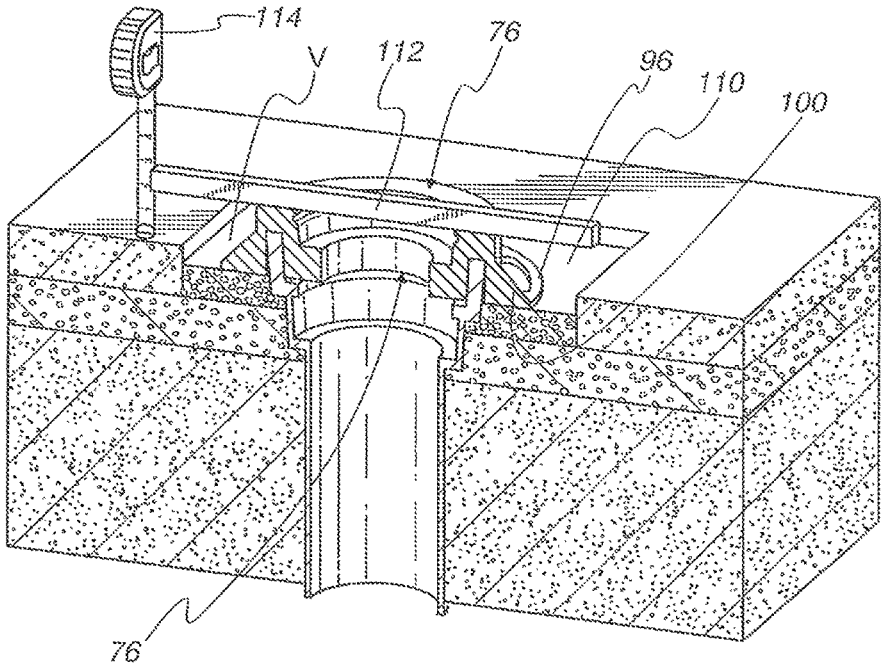
FIG. 25 is a view of the components as in FIG. 24 but from a different perspective.

As shown in FIGS. 24 and 25, a measurement is taken to determine the overall height of the main body 80 of the riser assembly 76 between the oppositely facing surface 98 and edge 84 required to have the edge 84 reside at the desired level SL. Preferably, a plurality of riser assemblies 76 with different vertical dimensions are pre-made and on hand so that the desired riser assembly 76 can be selected on a particular site. A selection can be verified by using a straight edge 112 and ruler 114 to calculate the thickness of the new asphalt layer that will place the finished surface 72 flush with the edge 84. The thickness of the layer 110 can also be controlled to set the height of the edge 84 where desired. As seen in FIGS. 23-25, gravel has been added to the void V and, as depicted, fills more than one half of the void depth.

Figure 26:
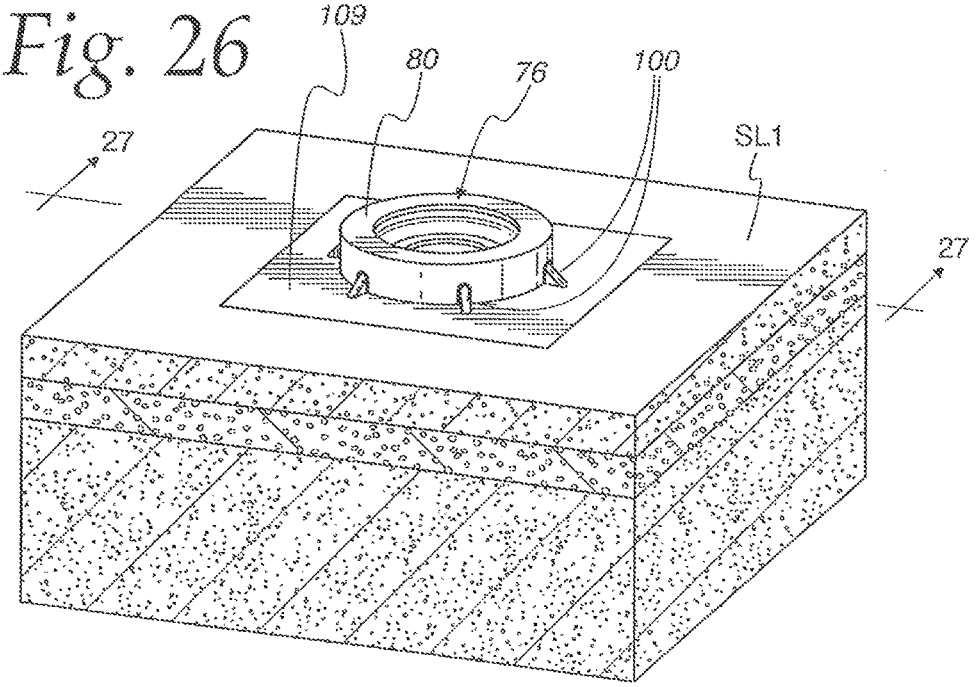
FIG. 26 is a view as in FIG. 22 with a settable material placed in the void to anchor the riser assembly.
Figure 27:
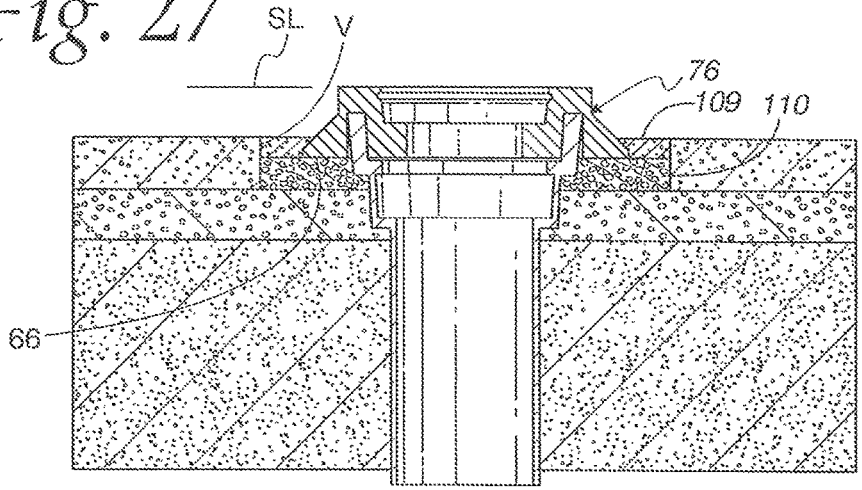
FIG. 27 is a cross-sectional view of the highway section, conduit, and riser assembly taken along line 27-27 of FIG. 26.
Figure 28:
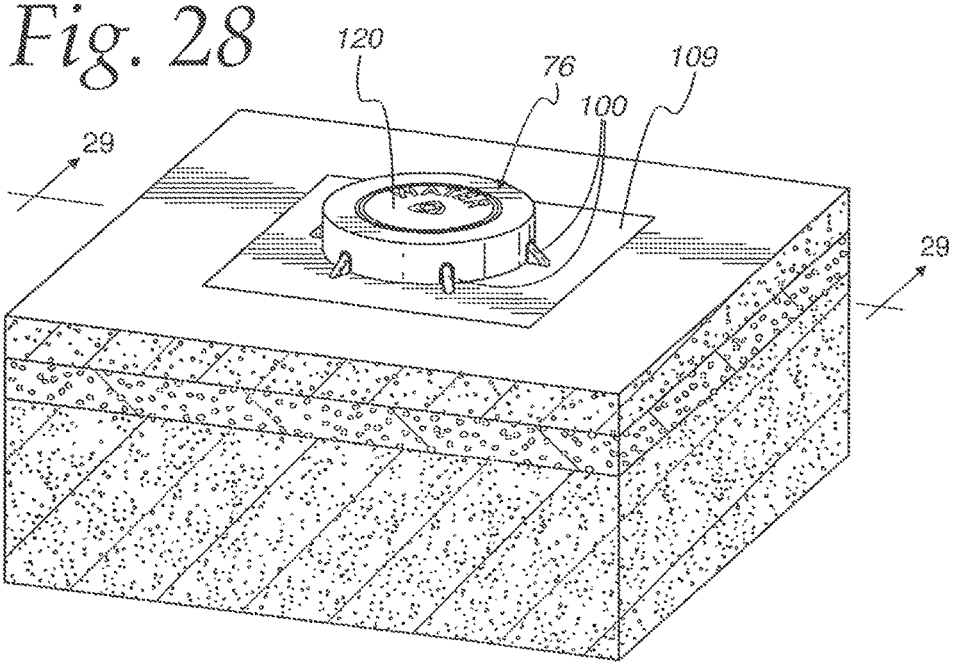
FIG. 28 is a view as in FIG. 26 with a cap assembly operatively positioned.
Figure 29:
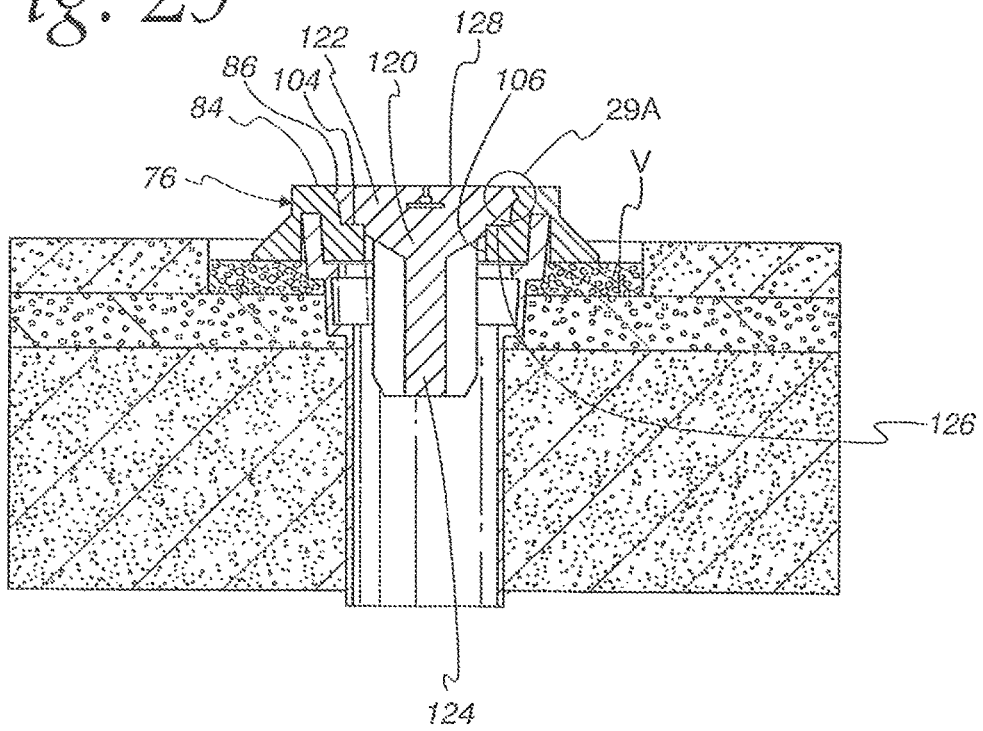
FIG. 29 is a cross-sectional view of the roadway section, conduit, riser assembly, and cap assembly taken along line 29-29 of FIG. 28.
Figure 29A:
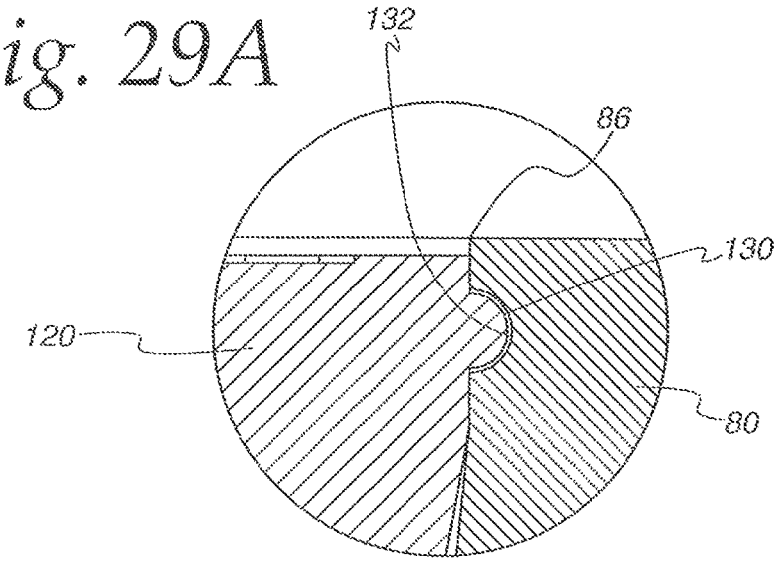
FIG. 29A is an enlarged view of a portion of a connection between the cap assembly and riser assembly within the circle 29A of FIG. 29.
Figure 30:
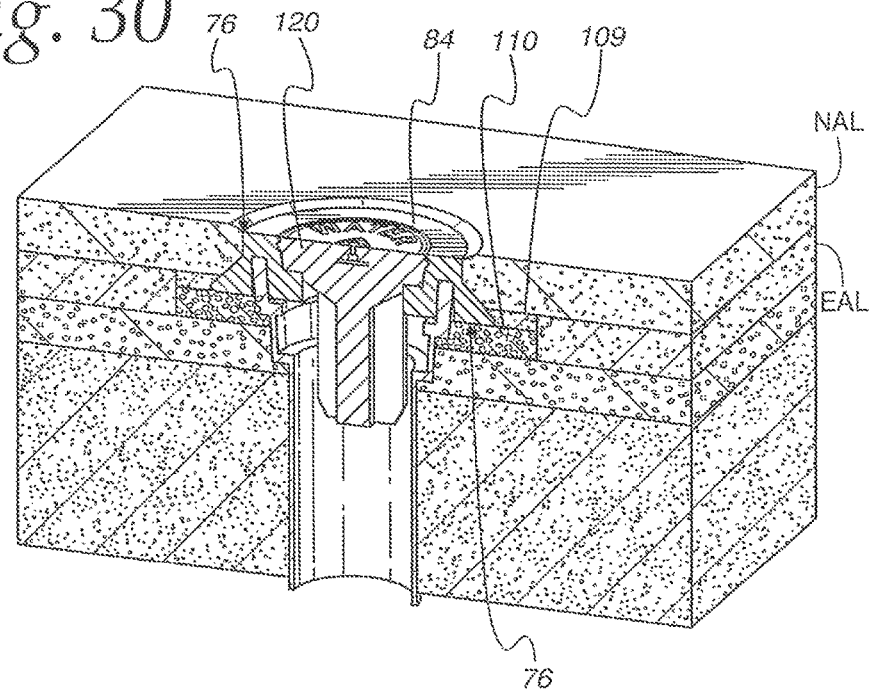
FIG. 30 is a view of components as in FIG. 29 with a finishing layer of asphalt applied and from a different perspective.
Figure 31:
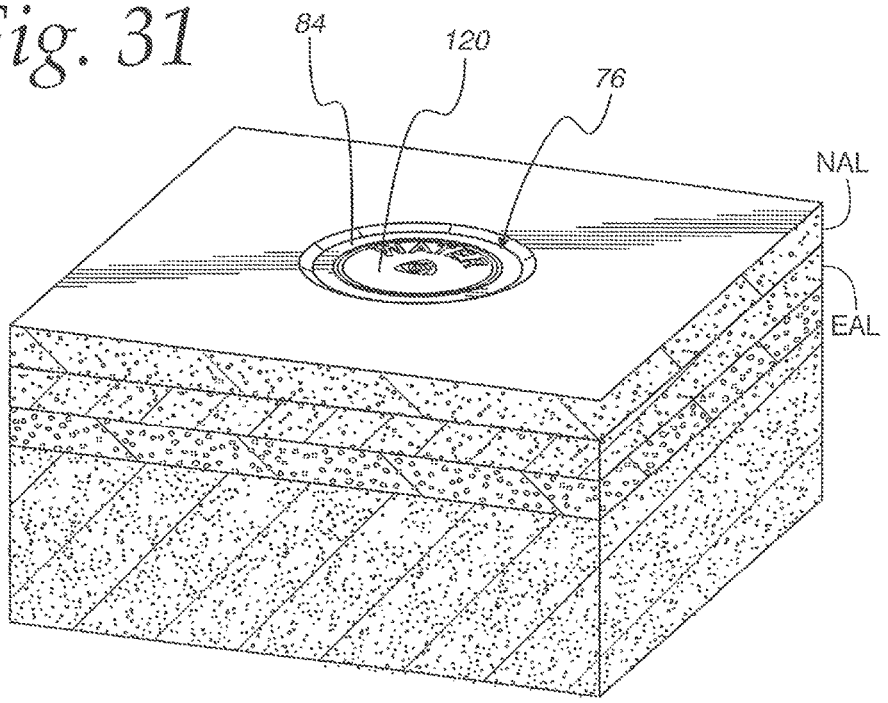
FIG. 31 is an unsectioned view of the components as in FIG. 28.

Thereafter, as shown in FIGS. 26 and 27, the void V is filled with concrete, or other settable material 109 up to the milled asphalt level SL1. Typically, the thickness of the concrete is in the range of 0.75 to 1 inch. Once the concrete, or other material 109, sets, the riser assembly 76 is positively fixed in place. The settable material 109, extending through the flange openings 108 and in which the gussets 100 are embedded, positively locks the riser assembly 76 in place. Further, the non-round shape of the void V keys the set material 109 and riser assembly 76 against turning around a vertical axis within the void V.

A cap assembly 120 can be used to selectively block the top entry/access opening 86. As depicted, the cap assembly 120 has a top portion 122 and a smaller diameter bottom portion 124. The bottom portion 124 guides the cap assembly 120 into the opening 106 to the point that an annular shoulder/stop 126 abuts to the surface 104, representing the fully assembled position for the cap assembly 120. In this position, an upper surface 128 on the cap assembly 120 is substantially flush with the top edge 84.

To maintain the assembled position for the cap assembly 120, an annular bead 130 is provided on the cap assembly 120 for reception in a complementarily-shaped recess 132 on the body 80. As the cap assembly 120 is pressed downwardly, the bead 130 and recess 132 align. Initially, the bead 130 is radially compressed as it is moved downwardly toward the recess 132. Upon being in registration therewith, the bead 130 is permitted to expand radially outwardly, thereby making a snap-fit connection. When desired, the cap assembly 120 can be wedged out of its assembled position to allow access to the passageway 18'.

In the depicted form, the riser assembly 76 is molded as a single piece from a non-metal material. In one preferred form, the riser assembly 76 is made from urethane.

The cap assembly 120 can likewise be made from a non-metal material. Urethane is also a preferred material of construction for the cap assembly 120. While one or both of the cap assembly 120 and riser assembly 76 might be made from metal, preferably at least one, and more preferably both, of the riser assembly 76 and cap assembly 120 are made from a non-metal material. Preferably at least portions of the cap assembly 120 and riser assembly 76 are made of a non-metal material where they interact.

Once the cap assembly is in operative relationship with/assembled to the conduit 10', the cap assembly 120 fully blocks the top entry/access opening 86. A snap-fit arrangement described above preferably produces a sealed connection to avoid migration of foreign material between the cap assembly 120 and riser assembly 76.

To complete the resurfacing, with the system in the state shown in FIGS. 26-29, new asphalt can be applied fully around the riser assembly 76 and compacted thereagainst so that all that remains exposed is the upwardly facing top edge 84 of the riser assembly 76 with the cap assembly 120 in operative relationship with the conduit 10' and riser assembly 76. Compaction of the asphalt can be carried out with conventional heavy equipment, thereby potentially obviating the need to hand tamp the asphalt around the perimeter of the conduit 10.

Numerous variations for the basic method described above are contemplated by the invention. As but one example, the levelling of the riser assembly 76 could be effected through settable concrete or other material.

The foregoing disclosure of specific embodiments is intended to be illustrative of the broad concepts comprehended by the invention.

The invention claimed is:

1. A method of forming an upwardly facing surface around a conduit that is embedded in ground material and defines a passageway, the conduit having an open upper end through which access can be gained to the passageway and an outer perimeter, the method comprising the steps of:

obtaining a riser assembly;

placing the riser assembly in operative relationship with the open upper end of the conduit wherein the riser assembly is supported at least partially by the ground material around the outer perimeter of the conduit, wherein with the riser assembly in operative relationship with the open upper end of the conduit, a portion of the riser assembly outside of the outer perimeter of the conduit is in vertically overlapping relationship with the outer perimeter of the conduit such that a horizontal reference plane is capable of passing through the portion of the riser assembly and the outer perimeter of the conduit, the riser assembly in the operative relationship with the open upper end of the conduit defining an entry opening to the passageway; and with the riser assembly in the operative relationship with the open upper end of the conduit, forming at least one material around the conduit to a desired vertical thickness on which the upwardly facing surface is defined.

2. The method of forming an upwardly facing surface around a conduit according to claim 1 wherein the ground material comprises an asphalt layer, a compacted gravel layer underlying the asphalt layer, and a road base layer underlying the compacted gravel layer, and the step of placing the riser assembly in operative relationship with the open upper end of the conduit comprises placing a downwardly facing surface on the riser assembly against at least one of the compacted gravel and road base layers.

3. The method of forming an upwardly facing surface around a conduit according to claim 1 wherein the conduit has a vertical central axis and the riser assembly comprises a ring-shaped component with a central axis, and with the riser assembly in the operative relationship with the open upper end of the conduit, the vertical central axis of the conduit and central axis of the ring-shaped component are angled with respect to each other.

4. The method of forming an upwardly facing surface around a conduit according to claim 1 wherein the riser assembly comprises a ring-shaped component and the portion of the riser assembly is a ring-shaped portion that surrounds the outer perimeter of the conduit and bears upon the ground material with the riser assembly in the operative relationship with the open upper end of the conduit.

5. The method of forming an upwardly facing surface around a conduit according to claim 1 wherein the conduit has a central axis and an annular upper edge and the step of obtaining a riser assembly comprises obtaining a riser assembly configured to define: a) a seat in which the annular upper edge of the conduit seats with the riser assembly in the operative relationship with the upper end of the conduit; and b) a curved portion that extends around the outer perimeter of the conduit and bears against the ground material with the riser assembly in operative relationship with the upper end of the conduit.

6. The method of forming an upwardly facing surface around a conduit according to claim 5 wherein the open upper end of the conduit has radially oppositely facing annular surfaces and the seat has an inverted "U" shape in cross section bounded by a surface and with the riser assembly in the operative relationship with the open upper end of the conduit separate portions of the surface bounding the seat face each of the radially oppositely facing annular surfaces on the open upper end of the conduit.

7. The method of forming an upwardly facing surface around a conduit according to claim 5 wherein the riser assembly comprises an annular body with a central axis and a flange projecting radially outwardly from the body and defining the curved portion of the riser assembly.

8. The method of forming an upwardly facing surface around a conduit according to claim 7 wherein the seat is defined on the annular body and the flange extends fully around the outer perimeter of the conduit.

9. The method of forming an upwardly facing surface around a conduit according to claim 7 wherein the flange has at least one elongate, fully surrounded opening therethrough and the step of forming the at least one material comprises directing the at least one material into the fully surrounded opening.

10. The method of forming an upwardly facing surface around a conduit according to claim 1 wherein the step of obtaining a riser assembly comprises providing a riser assembly made from a non-metal material.

11. The method of forming an upwardly facing surface around a conduit according to claim 1 wherein the step of obtaining a riser assembly comprises selecting a riser assembly from a plurality of riser assemblies having different vertical dimensions based on a particular site condition.

12. The method of forming an upwardly facing surface around a conduit according to claim 1 wherein the step of obtaining a riser assembly comprises obtaining a riser assembly with a ring-shaped component with a central axis, the ring-shaped component having a radially outwardly projecting flange, and the step of forming at least one material comprises forming the at least one material against the radially outwardly projecting flange.

13. The method of forming an upwardly facing surface around a conduit according to claim 12 wherein the at least one material comprises at least one of mortar, concrete and another flowable and settable material that hardens.

14. The method of forming an upwardly facing surface around a conduit according to claim 12 wherein the at least one material comprises asphalt.

15. The method of forming an upwardly facing surface around a conduit according to claim 1 wherein with the riser assembly in operative relationship with the open upper end of the conduit an upper entry opening to the passageway is defined and further comprising the steps of obtaining a cap assembly and placing the cap assembly in operative relationship with the conduit and riser assembly so that the cap assembly blocks the upper entry opening.

16. The method of forming an upwardly facing surface around a conduit according to claim 15 wherein the cap assembly and riser assembly are made from materials and configured so that non-metal portions of the cap assembly and riser assembly interact to maintain the cap assembly in the operative relationship with the conduit and riser assembly.

17. The method of forming an upwardly facing surface around a conduit according to claim 15 wherein the step of placing the cap assembly in the operative relationship with the conduit and riser assembly comprises snap fitting the cap assembly to the riser assembly.

18. The method of forming an upwardly facing surface around a conduit according to claim 17 wherein the cap assembly, riser assembly, and conduit are configured so that the cap assembly extends fully through the riser assembly and into the passageway with the cap assembly in the operative relationship with the conduit and riser assembly.

19. The method of forming an upwardly facing surface around a conduit according to claim 1 further comprising the step of removing ground material from around a pre-embedded conduit before placing the riser assembly in the operative relationship with the upper end of the conduit.

20. A method of forming an upwardly facing surface around a conduit that is embedded in ground material and defines a passageway, the conduit having an open upper end through which access can be gained to the passageway and an outer perimeter, the method comprising the steps of:

obtaining a riser assembly;

placing the riser assembly in operative relationship with the open upper end of the conduit wherein the riser assembly is supported at least partially by the ground material around the outer perimeter of the conduit, the riser assembly in the operative relationship with the open upper end of the conduit defining an entry opening to the passageway; and with the riser assembly in the operative relationship with the open upper end of the conduit, forming at least one material around the conduit to a desired vertical thickness on which the upwardly facing surface is defined, wherein the riser assembly comprises a ring-shaped component with a ring-shaped portion that surrounds the outer perimeter of the conduit and bears upon the ground material with the riser assembly in the operative relationship with the open upper end of the conduit, whereby with the riser assembly in operative relationship with the open upper end of the conduit, the ring-shaped portion and outer perimeter of the conduit are in vertically overlapping relationship such that a horizontal reference plane is capable of passing through the ring-shaped portion and outer perimeter of the conduit.

21. The method of forming an upwardly facing surface around a conduit according to claim 20, wherein the step of obtaining a riser assembly comprises obtaining a riser assembly made from a non-metal material.

22. The method of forming an upwardly facing surface around a conduit according to claim 21 wherein the step of obtaining a riser assembly comprises obtaining a riser assembly wherein the annular body is molded from a urethane material.

* * * * *